US008439102B1

(12) United States Patent
Collins, III et al.

(10) Patent No.: US 8,439,102 B1
(45) Date of Patent: May 14, 2013

(54) VECTOR TILE, REFRACTORY ASSEMBLY UNIT INCLUDING SAME AND REFRACTORY ARRAY INCLUDING SAME

(75) Inventors: Edwin L. Collins, III, Albany, NY (US); Jeffrey J. Bolebruch, Amsterdam, NY (US); Nathaniel Teator, Cohoes, NY (US)

(73) Assignee: Blasch Precision Ceramics, Albany, NY (US)

( * ) Notice: Subject to any disclaimer, the term of this patent is extended or adjusted under 35 U.S.C. 154(b) by 777 days.

(21) Appl. No.: 12/583,622

(22) Filed: Aug. 24, 2009

Related U.S. Application Data

(60) Provisional application No. 61/091,514, filed on Aug. 25, 2008.

(51) Int. Cl.
*F28F 19/00* (2006.01)
*F28F 9/22* (2006.01)

(52) U.S. Cl.
USPC ..... 165/134.1; 165/174; 165/178; 122/512

(58) Field of Classification Search ..... 165/134.1, 165/115, 174, 178, 158; 122/511, 512
See application file for complete search history.

(56) References Cited

U.S. PATENT DOCUMENTS 1,748,129 A * 2/1930 Hughes ..... 165/174
1,795,055 A * 3/1931 Taylor et al. ..... 165/134.1
2,424,441 A * 7/1947 Edmonds ..... 165/174
2,753,932 A * 7/1956 Eckstrom et al. ..... 165/174
5,613,553 A * 3/1997 Hong ..... 165/140
5,647,432 A 7/1997 Rexford et al.
5,954,121 A 9/1999 Rexford et al.
5,979,543 A * 11/1999 Graham ..... 165/158
6,173,682 B1 * 1/2001 Parnell et al. ..... 165/134.1
6,923,251 B2 * 8/2005 Higashiyama ..... 165/174
6,973,805 B2 * 12/2005 Higashiyama ..... 165/174

* cited by examiner

*Primary Examiner* — Leonard R Leo
(74) *Attorney, Agent, or Firm* — Burr & Brown

(57) ABSTRACT

A refractory brick assembly unit is provided, including a refractory brick member having an inner passageway extending therethrough from a first opening at an inlet end face to an opposed second opening at an outlet end face thereof. A vector tile is also included, having an annular portion that is coaxially arranged with respect to a longitudinal extension axis of the inner passageway of the refractory brick member positioned in a portion of the inner passageway of the refractory brick member and located proximate the second opening at the outlet end face thereof, and having a domed portion extending from a first surface of the annular portion at a predetermined angle with respect to the longitudinal extension axis of the inner passageway of the refractory brick member so as to occlude at least a portion of the second opening of the refractory brick member at the outlet end face thereof.

12 Claims, 15 Drawing Sheets
(2 of 15 Drawing Sheet(s) Filed in Color)

3
32
36
II
II
34
35
36
I
I

VECTOR TILE, REFRACTORY ASSEMBLY UNIT INCLUDING SAME AND REFRACTORY ARRAY INCLUDING SAME

BACKGROUND OF THE INVENTION

Large scale industrial heat sources are used for a variety of applications in industry, including sulfur recovery units, waste incinerators, and the like. Waste heat boilers are commonly used with many types of industrial heat sources to extract heat from waste gases of an industrial process to cause a component thereof to condense, or use that heat in another process or even to provide heat for the industrial facility. This is becoming increasingly important in view of global awareness of environmental preservation issues and with respect to adherence and enforcement of stricter industrial regulations, with respect to efficiency and pollution products.

An example of a waste heat boiler includes a plurality of metal boiler tubes supported by opposed metal tube sheets, as described in U.S. Pat. No. 5,954,121, the entirety of which is incorporated herein by reference. The tube sheets define a vessel for holding water or some other form of heat transfer medium. Hot waste gas passes through the boiler tubes arranged in the inlet tube sheet and heat is extracted therefrom via heat transfer from the hot gas to the heat transfer medium contained within the confines of the tube sheets. However, concerns exist with respect to compensating for the corrosive nature of the heat and gas produced by the incinerator flame, and the damage that such heat and gas can inflict on the metal components of the waste heat boiler. These concerns are addressed, for example, in U.S. Pat. No. 5,647,432, the entirety of which is also incorporated herein by reference. The '432 patent discloses refractory ferrules that are arranged to form protective wall to protect the metal components of the waste heat boiler from the corrosive nature of the incinerator heat/flame.

Improving reaction furnace efficiency is a major concern. Feed components need an adequate amount of time to fully react, and it is important to eliminate any impurities and intermediate reaction products in order to avoid undesirable reactions or other problems downstream. In addition, another concern is the prevention of corrosion of the reaction vessel and its components. Another concern exists with respect to improving the overall efficiency of the system's heat exchanging capabilities. That is, in many cases, the incinerator flame is typically not as long or wide as the vessel, and as a result, only the central tubes of the waste heat boiler effectively receive the majority of the incinerator flame, creating a hot spot at the center of the tube sheet.

In an attempt to address these concerns, one industry practice has been to implement the construction of a plurality of baffle walls between the burner and tube sheet of a waste heat boiler. These baffle walls are also provided to increase gas mixing, and thereby improve reaction efficiency. Reaction furnaces having a baffle wall construction include a plurality of spaced apart, staggered partial walls, alternately extending from opposite parts of the reaction chamber (floor and ceiling) to create a snaking gas flow therethrough over and under the alternating baffles. One problem recognized with this type of construction, however, is that dead zones are unavoidably formed behind each baffle, where no effective mixing occurs. Another problem is that baffle construction is mechanically difficult to maintain in that a plurality of partial walls extending upwardly and downwardly are not as structurally sound as a single wall traversing from top to bottom (floor to ceiling). Extra plant space, reaction furnace space, and expensive construction materials such as fire brick, etc. are required in connection with the baffle wall type construction, all which are not effectively utilized in view of the presence of the dead zones.

Another industry practice is to erect a refractory diffusor wall between the burner and tube sheet of a waste heat boiler. These diffusor walls are also referred to as checkerwalls, and have been provided to increase gas mixing, and thereby improve reaction efficiency. Checkerwalls also serve to reduce the amount of radiant heat transfer to the tube sheet, preventing thermal reactions that can physically degrade the tube sheet or lead to corrosion of the tube sheet, thereby extending the refractory life of the tube sheet, for example to achieve improved heat distribution of the incinerator flame across the entire face of the tube sheet of the waste heat boiler.

Such traditional checkerwall-type diffusor walls are typically formed of a standard-type refractory brick, typically 9" by 2.5" by 4.5," arranged in a shape of a standard wall, wherein alternating bricks are omitted to give the appearance of a checkerboard as shown in FIG. 15 (thus the name). In most cases, standard refractory brick are mortared together to define this open configuration. The typically rectangular or square holes defined by the missing bricks in the checkerwall allow the incinerator gas to pass therethrough and serve to provide a more uniform heat distribution across the entire face of the tube sheet of the waste heat boiler. However, these bricks are subject to thermal cycling, which causes the mortar to crack and fail. The overall design of traditional checkerwalls is not inherently stable, as the bricks are flat spans in constant tension, and field experience shows that this design has a tendency to fall over during a campaign.

The '121 patent discloses a different type of refractory brick particularly suited for constructing a diffusor wall (herein also referred to as a hexwall). As shown in FIG. 14, and example of such a hexwall 61 includes an array of 79 hex bricks each having a thickness of 9" and 8" diameter through-holes or passageways therethrough. This refractory brick is similar to that described below in connection with FIGS. 1A-1C, and includes a substantially tubular body having a passageway extending therethrough in the longitudinal direction of the body. The outer peripheral surface of the refractory brick has a complementary shape that allows for the engagement of mating means to mechanically couple a plurality of the bricks to one another, without the need for permanent adhesive, so as to cooperatively form an inherently stable diffusor wall.

In addition to offering the benefits of faster and more stable construction, without the need for mortar, another advantage of these particular hexagonal-type refractory bricks is that, when the bricks are formed in the shape of hexagons with a circular passageway formed therethrough, the open frontal area of the overall diffusor wall can reach about 50%, thereby allowing higher volume flow of exhaust gas to pass therethrough. The hexagonal bricks and the diffusor wall described in the '121 patent offer improved overall heat transfer efficiency of the waste heat boilers associated with industrial heat sources, particularly when compared to the traditional design.

It should be noted, however, that there is still a need to improve the various performance factors affecting the overall system, such as mixing efficiency, residence time, pressure drop across the system and radiant heat transfer. In addition, it would be desirable to provide simple and effective means to specifically control one or more performance factors contemporaneously in order to tailor a combination of performance factors for improved overall efficiency. No such means have been proposed heretofore.

SUMMARY OF THE INVENTION

It is an object of the present invention to overcome the drawbacks associated with the prior art and to address the heretofore unsolved needs described above. In particular, it is an object of the present invention to provide simple and effective means for affecting and improving the various performance factors of the overall system, such as mixing efficiency and gas flow, residence time, pressure drop across the system and radiant heat transfer, by modifying the gas flow at the output face of the diffusor wall. It is also an object of the present invention to provide a diffusor wall that is mechanically stable, that does not waste valuable plant space and furnace materials, that increases the effective available reaction volume by an amount of about two times, which thereby enables a reduction by about one half of the overall length of the reaction chamber, which thereby reduces plant costs, production costs, improves efficiency, and offers improved stability with reduced maintenance risks.

The term "mixing efficiency" used herein relates to the disruption of the gas flow creating turbulence, which is used to measure the extent of mixing. Factors such as gas flow rate, composition, and temperature affect mixing. The mixing efficiency of the gas passing through the diffusor wall impacts the overall process in several different ways, as described above. In view of the above, it is desirable to achieve an optimal mixing efficiency and to be able to control and/or modify the amount of mixing as needed.

The term "residence time" used herein relates to the amount of time a discrete quantity of feed gas is inside the reaction furnace. Factors such as gas flow rate, composition, temperature and vessel volume affect residence time. An example of a typical residence time for a reaction furnace is 0.6-5 sec. The residence time of the gas on the upstream side of the diffusor wall impacts the overall process, for example, by affecting the amount of time available for the gas to complete the intended thermal/chemical reactions before passing through the diffusor wall. The present invention provides the ability to obtain a greater degree of mixing (i.e., increased mixing and reaction efficiency) without increasing the residence time, which is highly desirable, by increasing the effective mixing capacity of the system through the use of the vector tiles. That is, by virtue of the application of the vector tiles according to the present invention, it is now possible to utilize more of, if not the entire reaction chamber, which offers flexible solutions to a variety of different situations such as situations where a concentration of reactants is occurring at some location within the reaction zone that does not fully convert by the end of the reaction zone, which causes problems further downstream. The flexibility is not limited to controlling the reaction capacity based on the cross-sectional area of the refractory brick members of the diffusor wall, as is the case with the refractory insert members disclosed copending U.S. patent application Ser. No. 12/156,838, the entirety of which is incorporated herein by reference.

The term "pressure drop" used herein relates to the as the loss in pressure across the system. The pressure differential is measured between the pressure on the upstream side of the diffusor wall and the pressure on the downstream side of the diffusor wall. A high pressure drop across the diffusor wall tends to decrease the mass flow rate and reduce throughput. Accordingly, large pressure drops of this nature are preferably minimized.

The term "radiant heat transfer" used herein relates to the amount of radiant heat from the burner that is transferred past the diffusor wall. As mentioned above, such diffusor walls serve as an added thermal barrier between the furnace burners on the upstream side thereof and the downstream tube sheet, to help prevent the formation localized hot spots in conjunction with the adjacent ferrules. For example, the amount of open frontal surface area of the diffusor wall is one attribute of the bricks of the diffusor wall that can affect the amount of radiant heat transfer therethrough. As the line of sight through the passageways of the bricks of the diffusor wall is decreased, the amount of radiant heat transfer likewise decreases. If the amount of radiant heat transfer is not regulated to be as uniform as possible, and if it is allowed to become too great, the formation of downstream hot spots and the like could have catastrophic effects on the system.

According to a first embodiment of the present invention, a vector tile is provided, comprising an annular portion having a first surface defining a first opening and an opposed second surface defining a second opening, and having an integral domed portion extending from a portion of the first surface of the annular portion at a predetermined angle defined at a junction point so that the domed portion occludes at least a portion of the second opening. Preferably, the predetermined angle is in a range of 30-90°.

According to a second embodiment of the present invention, a refractory array, also referred to as a vector wall, is provided, comprising a plurality of refractory brick members, each having an inner passageway extending therethrough from a first opening at an inlet end face to an opposed second opening at an outlet end face thereof, the refractory brick members being arranged to define an array having an inlet face and an outlet face, and a plurality of vector tiles, each having an annular portion that is coaxially arranged in a portion of the inner passageway of the refractory brick members and located proximate the second opening at the outlet end face thereof, and each having a domed portion extending from a first surface of the annular portion at a predetermined angle so as to occlude at least a portion of the second openings of the refractory brick members at the outlet face of the array.

According to one aspect of the second embodiment of the present invention, the vector tiles are arranged so that the domed portions each extend in the same direction. According to another aspect, the vector tiles are arranged so that adjacent ones of the domed portions extend in different directions.

According to a third embodiment of the present invention, a refractory assembly unit is provided, comprising a refractory brick member having an inner passageway extending therethrough from a first opening at an inlet end face to an opposed second opening at an outlet end face thereof, and a vector tile having an annular portion that is coaxially arranged with respect to a longitudinal extension axis of the inner passageway of the refractory brick member positioned in a portion of the inner passageway of the refractory brick member and located proximate the second opening at the outlet end face thereof, and having a domed portion extending from a first surface of the annular portion at a predetermined angle with respect to the longitudinal extension axis of the inner passageway of the refractory brick member so as to occlude at least a portion of the second opening of the refractory brick member at the outlet end face thereof.

According to one aspect of the third embodiment of the present invention, the inner passageway of the refractory brick member has an annular rim proximate the second opening having a diameter that is greater than a diameter of a remainder of the inner passageway of the refractory brick member. Preferably, the diameter of the annular rim is greater than the diameter of the remainder of the inner passageway of the refractory brick member by an amount that corresponds to a thickness "t" of the annular portion of the vector tile. It is also preferred that the annular rim extends inwardly from the second opening a distance that corresponds to a height "h" of the annular portion of the vector tile.

According to one aspect of the third embodiment of the present invention, the refractory assembly unit further comprises a refractory cement provided in the annular rim and interposed between the refractory brick member and the vector tile.

According to a fourth embodiment of the present invention, a reaction furnace is provided, comprising a reaction chamber at least two refractory arrays, or vector walls, according to the present invention provided in the reaction chamber and spaced a distance apart from one another to define a first, upstream vector wall and a second, downstream vector wall. The vector tiles in the first vector wall are arranged to extend in a direction that is different from a direction in which the vector tiles of the second vector wall extend.

According to one aspect of the fourth embodiment of the present invention, the vector tiles in the first vector wall are arranged to extend in of a top-facing, a bottom-facing, a left-facing, a right-facing and a vortex configuration, and the vector tiles in the second vector wall are arranged to extend in another one of the top-facing, the bottom-facing, the left-facing, the right-facing and the vortex configuration.

According to another aspect of the fourth embodiment of the present invention, the at least two vector walls comprises three or more vector walls, including at least a third vector wall that is located downstream from the second vector wall. Preferably, the vector tiles in the first vector wall are arranged to extend in one of a top-facing, a bottom-facing, a left-facing, a right-facing and a vortex configuration, the vector tiles in the second vector wall are arranged to extend in another one of the top-facing, the bottom-facing, the left-facing, the right-facing and the vortex configuration, and the vector tiles in the third vector wall are arranged to extend in one of the top-facing, the bottom-facing, the left-facing, the right-facing and the vortex configuration that is different at least with respect to the configuration of the second vector wall.

BRIEF DESCRIPTION OF THE DRAWINGS

The patent application file contains at least one drawing executed in color, as noted herein below. Copies of this patent or patent application publication with color drawing(s) will be provided by the Office upon request and payment of the necessary fee.

FIG. 1A is a cross-sectional view of an example of a refractory brick member 3, wherein FIG. 1B is a longitudinal cross-sectional view taken along line I-I of FIG. 1A and the cross-sectional view of FIG. 1A is taken along line II-II of FIG. 1B.

FIG. 2A is a cross-sectional view of an example of a refractory brick member 31 that is used in conjunction with the vector tiles according to the present invention, wherein

DETAILED DESCRIPTION OF THE INVENTION

Figures 1A, 1B:
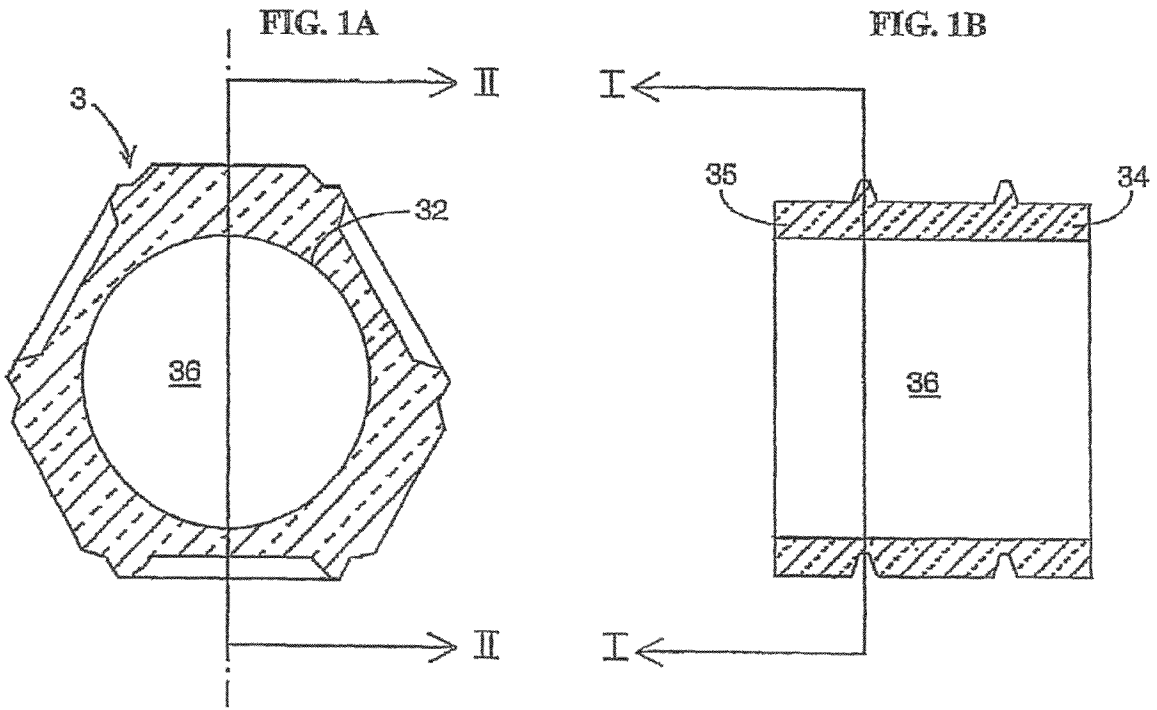
Figure 1C:
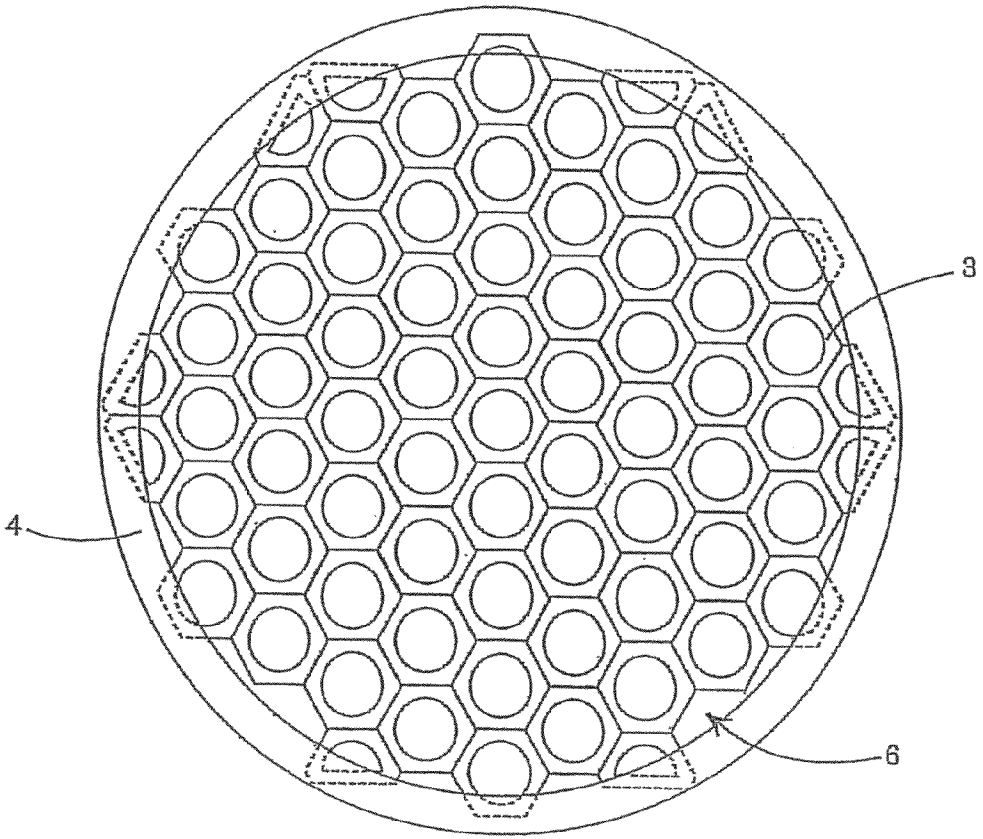
FIG. 1C is an example of a checkerwall or refractory brick array 6 which can be formed from arranging and joining a plurality of refractory bricks corresponding to the refractory brick shown in FIGS. 1A and 1B in a reaction vessel 4.
Figure 2B:
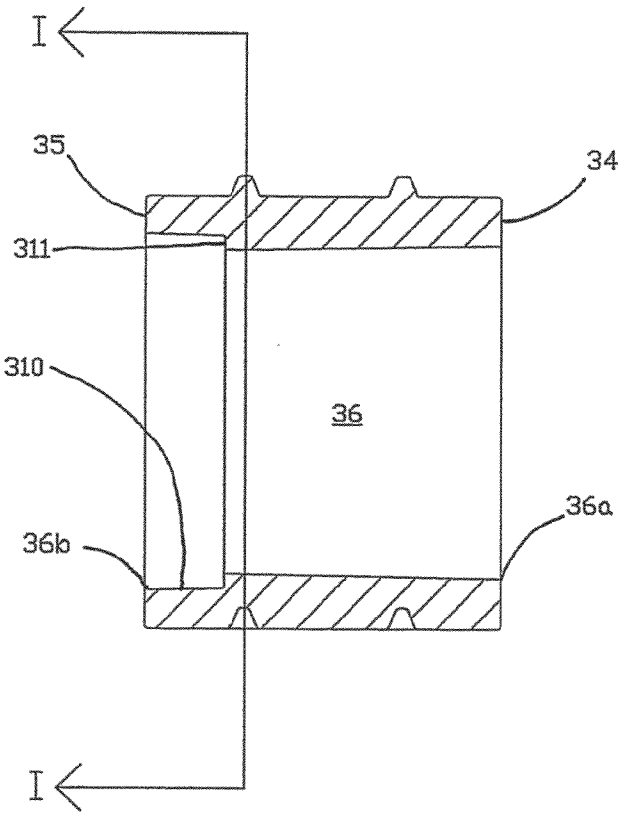
FIG. 2B is a longitudinal cross-sectional view taken along line I-I of FIG. 2A, and the cross-sectional view of FIG. 2A is taken along line II-II of FIG. 2B.
Figure 2A:
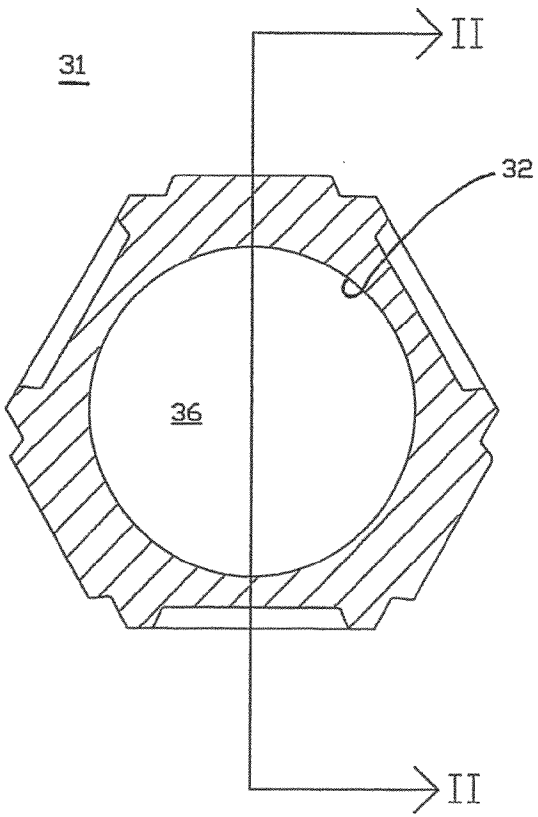

FIG. 1A is a cross-sectional view of an example of a refractory brick member 3, wherein FIG. 1B is a longitudinal cross-sectional view taken along line I-I of FIG. 1A and the cross-sectional view of FIG. 1A is taken along line II-II of FIG. 1B. FIG. 1C is an example of a checkerwall or refractory brick array 6 which can be formed from arranging and joining a plurality of refractory bricks corresponding to the refractory brick shown in FIGS. 1A and 1B in a reaction vessel 4. FIG. 2A is a cross-sectional view of an example of a refractory brick member 31 that is used in conjunction with the vector tiles according to the present invention, wherein FIG. 2B is a longitudinal cross-sectional view taken along line I-I of FIG. 2A, and the cross-sectional view of FIG. 2A is taken along line II-II of FIG. 2B.

Figure 3:
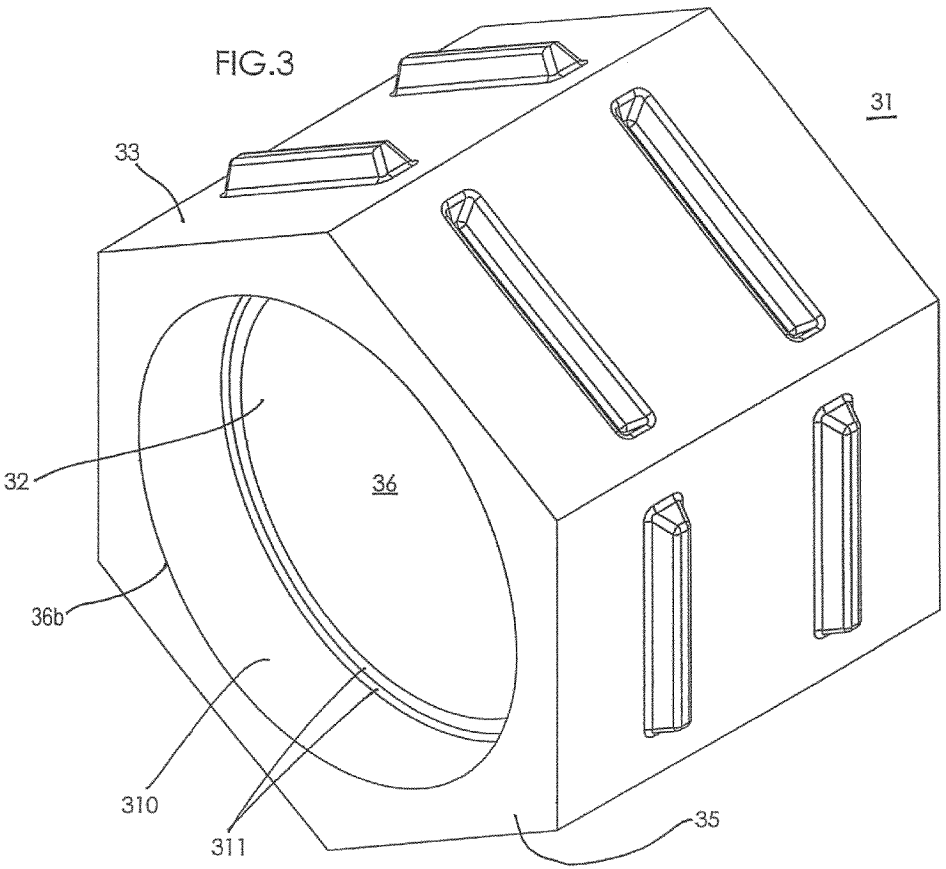
FIG. 3 is a perspective view of the downstream or outlet end face 35 of the refractory brick member 31 shown in FIGS. 2A-B.

The refractory brick member 3 (and likewise, the refractory brick member 31 described below in connection with FIGS. 2 and 3) has a substantially tubular body. The term "tubular" used herein is intended to describe elongate structures that are generally understood to include a though bore formed therethrough with openings on the opposed end faces thereof. It should be noted, however, that the inner and outer peripheral surfaces thereof are not limited to having a cylindrical shape. In particular, the inner surface 32 of the refractory brick members 3, 31 is preferably cylindrical, but as shown, the outer peripheral surface 33 of the refractory brick members 3, 31 is hexagonal.

Figure 15:
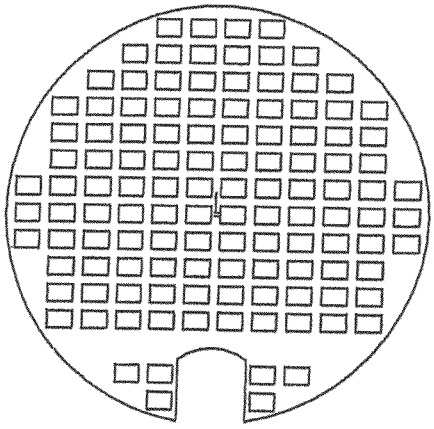
FIG. 15 PRIOR ART
FIG. 15 is a front view of a conventional checkerwall comprising a refractory array of traditional rectangular bricks.

As shown in FIG. 1B (and FIG. 2B with respect to refractory brick member 31), the refractory brick members 3, 31 have a first end 34 (i.e., an inlet or face side) and a second opposed end 35 (i.e., and outlet or rear side). The cylindrical inner surface 32 defines a through hole in the form of a tubular passageway 36 that extends in the longitudinal axis direction of the refractory brick member from an opening 36*a* at the first end 34 toward an opposed opening 36*b* at the second end 35. When a plurality of such refractory brick members 3 are arranged to form a refractory array or diffusor wall 6 inside a vessel 4, as shown in FIG. 1C, hot exhaust gas emitted from a burner located on the inlet or face side (first end 34) of the refractory brick members 3, 31 passes through the arrayed passageways 36 of the refractory bricks. The diffusor wall 6 has an open frontal area of about 50%, which enables a substantial amount of exhaust gas to flow therethrough, compared to the conventional "checkerwall" formed of standard refractory bricks, as shown in FIG. 15, for example, and which typically only offers an open frontal area of about 30%.

These refractory brick members 3, 31 for use in accordance with the present invention can be made of any type of refractory material, including ceramic materials. Alumina is preferred with respect to cost considerations and its ease of manufacture. Other suitable examples include refractory ceramics such as mullite. In this regard, the refractory bricks 3 can be made by many different conventional ceramic manufacturing processes such as slip casting, injection molding, extrusion followed by machining, for example. A preferred method of forming the refractory bricks 3, 31 is the freeze cast process described in U.S. Pat. No. 4,246,209, the entirety of which is incorporated herein by reference.

The refractory brick member 31 shown in FIGS. 2A, 2B, 3 and 5-7 includes an annular rim 310 formed along the inner surface 32 thereof, proximate the periphery of the opening 36*b* at the outlet face 35. The annular rim 310 radially extends inwardly a distance that preferably corresponds to a height "h" of the annular ring portion 101 of the vector tile 100 (see, e.g., FIG. 4). The annular rim 310 terminates at the ridge 311, which circumscribes the cylindrical inner surface 32 defining the tubular passage 36 of the refractory brick member 31.

The diameter of the annular rim 310 is greater than that of the inner diameter of the remainder of the tubular passage 36 by an amount that corresponds approximately to a thickness "t" of the annular ring portion 101 of the vector tile 100. This is explained in more detail below.

Figure 4:
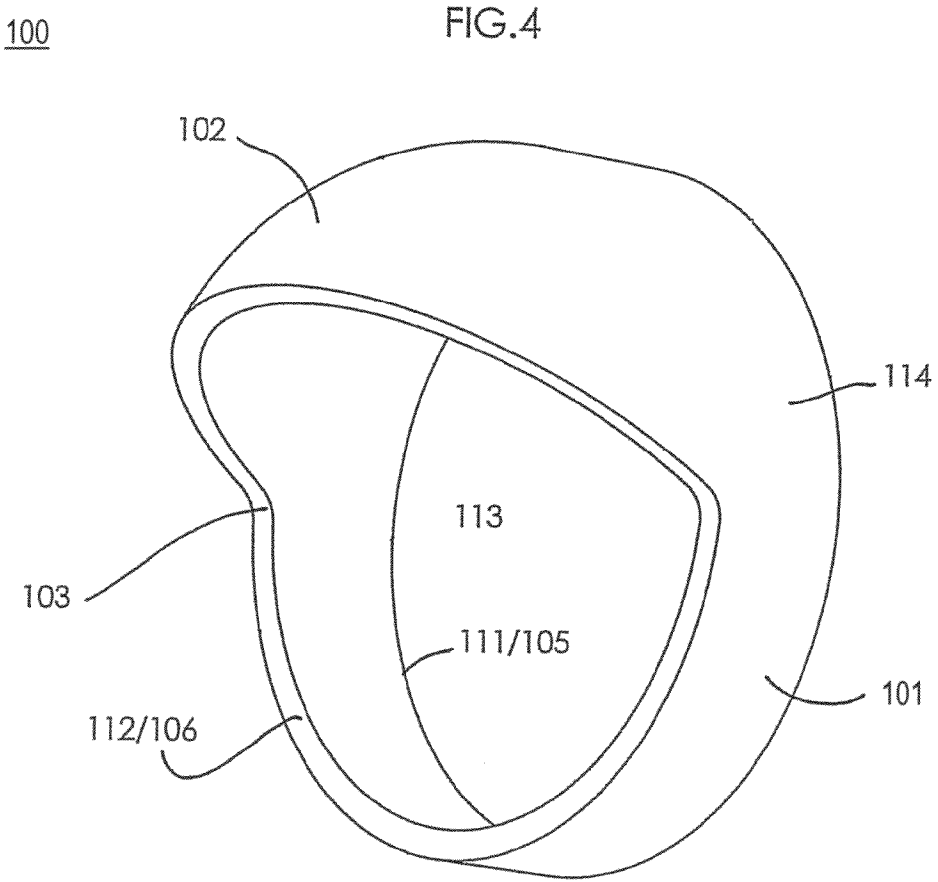
FIG. 4 is a perspective view of a vector tile 100 according to one embodiment of the present invention.

FIG. 4 is a perspective view of a vector tile 100 according to one embodiment of the present invention. Each vector tile 100 includes an annular or ring-like portion 101 having a first end surface 111 defining an opening 105 and an opposed second end surface 112 defining an opening 106. The annular portion 101 also has an inner circumferential surface 113 and an outer circumferential surface 114. A domed portion 102 extends outwardly from the second end surface 112 of the annular portion 101 at a predetermined angle, defined by the radius of curvature at the junction point 103, and occludes or covers at least a portion of the opening 106 thereof.

Figure 5:
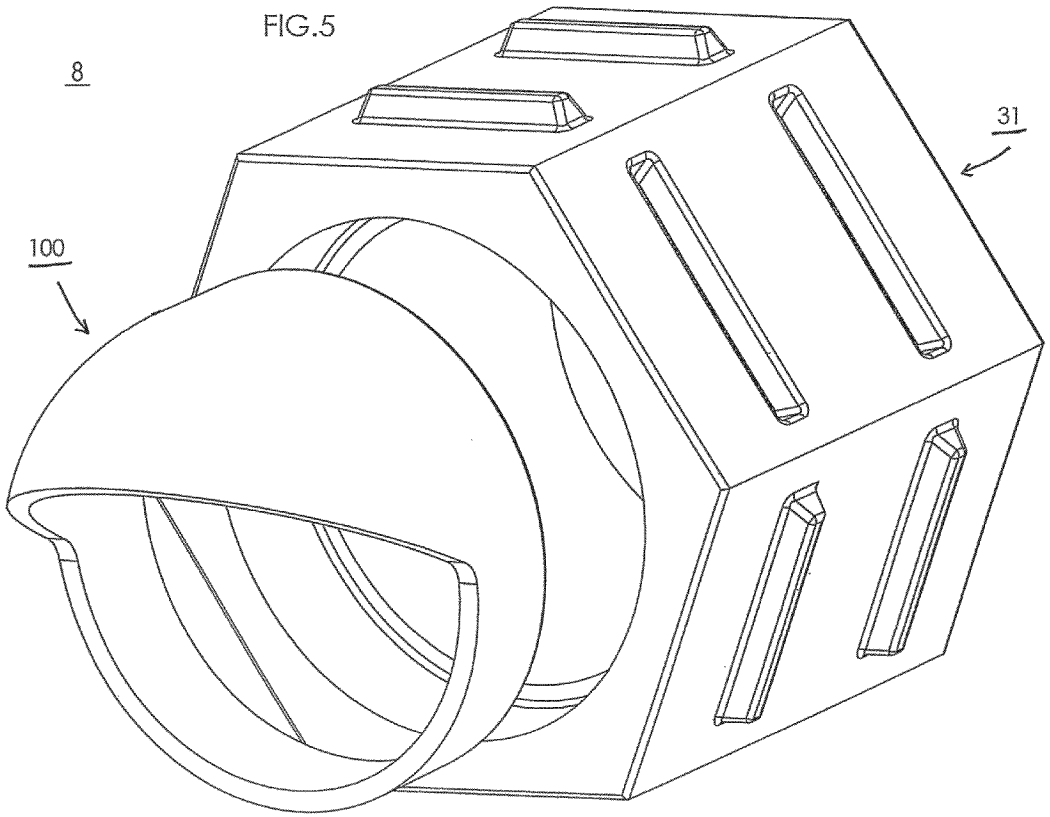
FIG. 5 is an exploded assembly view of a refractory brick member 31 and the vector tile 100 shown in FIG. 4 being assembled to form a refractory assembly unit 8.
Figure 6:
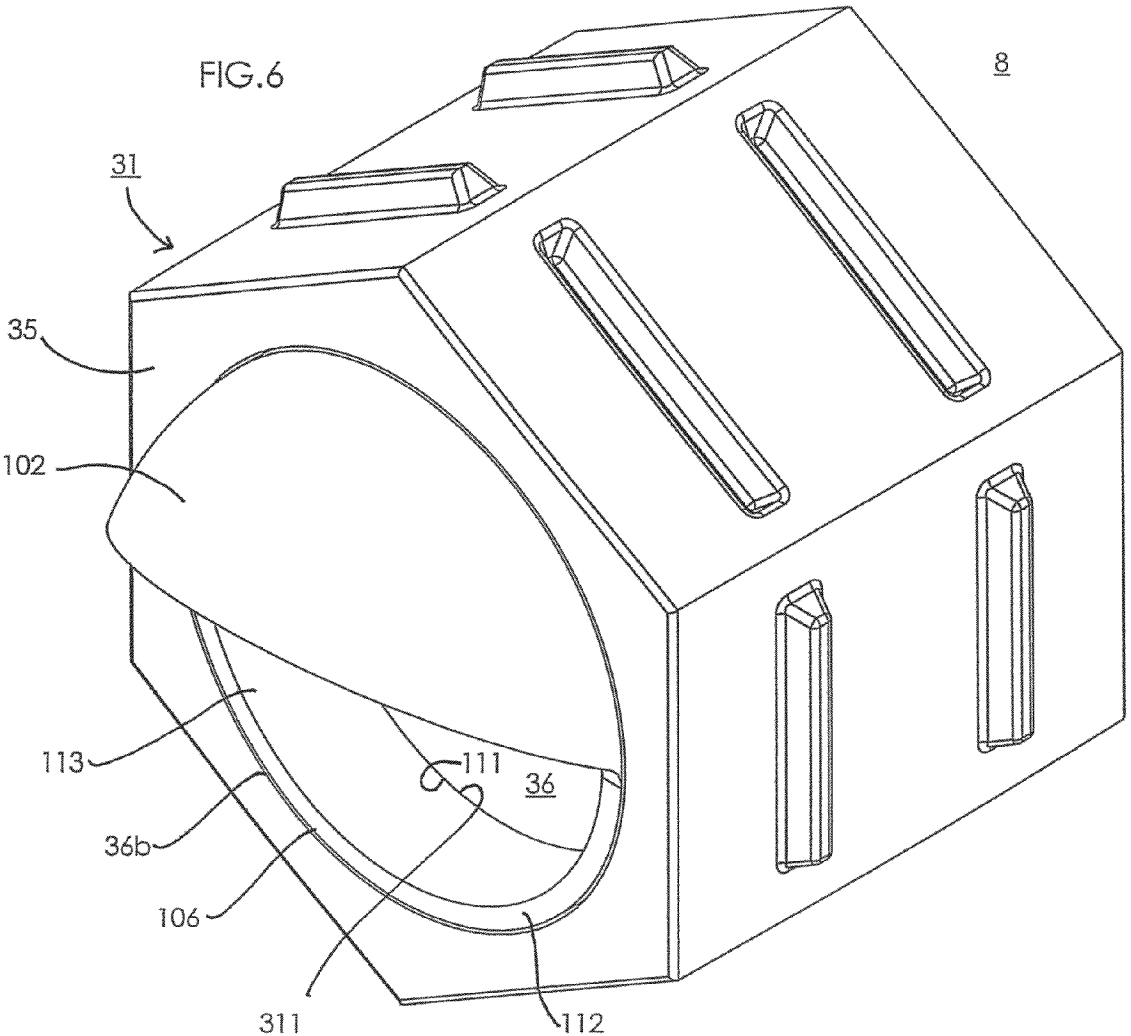
FIG. 6 is a perspective assembled view of the refractory assembly unit 8 including the refractory brick member 31 and the vector tile 100 of FIG. 4.
Figure 7:
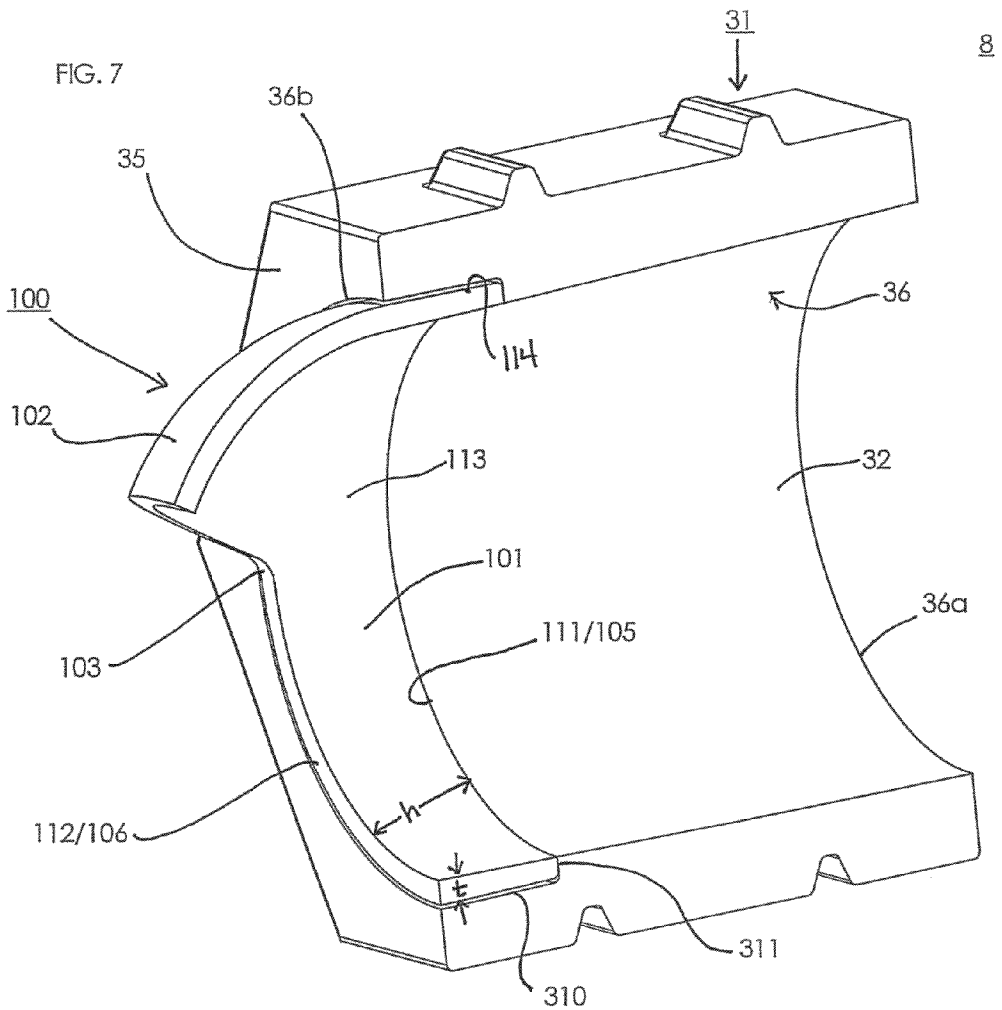
FIG. 7 is a sectional view of the perspective view of the refractory assembly unit 8 shown in FIG. 6.

The annular portion 101 of the vector tile 100 is received in the annular rim 310 of the refractory brick member 31 (as shown in FIGS. 5-7) and is secured therein using a refractory cement or other suitable adhesive means, for example. The first surface 111 of the annular portion 101 of the vector tile 100 preferably abuts against the terminal end 311 of the annular rim 310 in the passageway 36 of the refractory brick member 31. The opening 106 at the second end surface 112 of the annular portion of the vector tile 100 coaxially aligns with the opening 36*b* of the refractory brick member 31. The inner diameter $ID_{113}$ of the inner circumferential surface 113 of the annular portion 101 of the vector tile 100 is the same as the inner diameter of the passageway 36, so that when properly positioned in the assembled state, the gas will flow uninterruptedly through the passageway 36 of the refractory brick member 31 and pass through the vector tile 100 inserted therein—That is, until the gas reaches the outlet end face 35 of the refractory brick members, where its path will be redirected by the provision of the domed portions 102 of the vector tiles 100 that partially occlude the otherwise aligned openings 36*b*/106.

The angle of inclination of the domed portion 102 controls the magnitude of flow direction change and the speed of the gas passing through the vector tile 100 at the outlet face of the refractory brick member 31. The angle of inclination of the domed portion 102 is controlled by changing the radius of curvature of the junction 103. Preferably, the angle of inclination of the domed portion 102 is in a range between 30° and 90°.

Figures 8A, 8B, 8C:
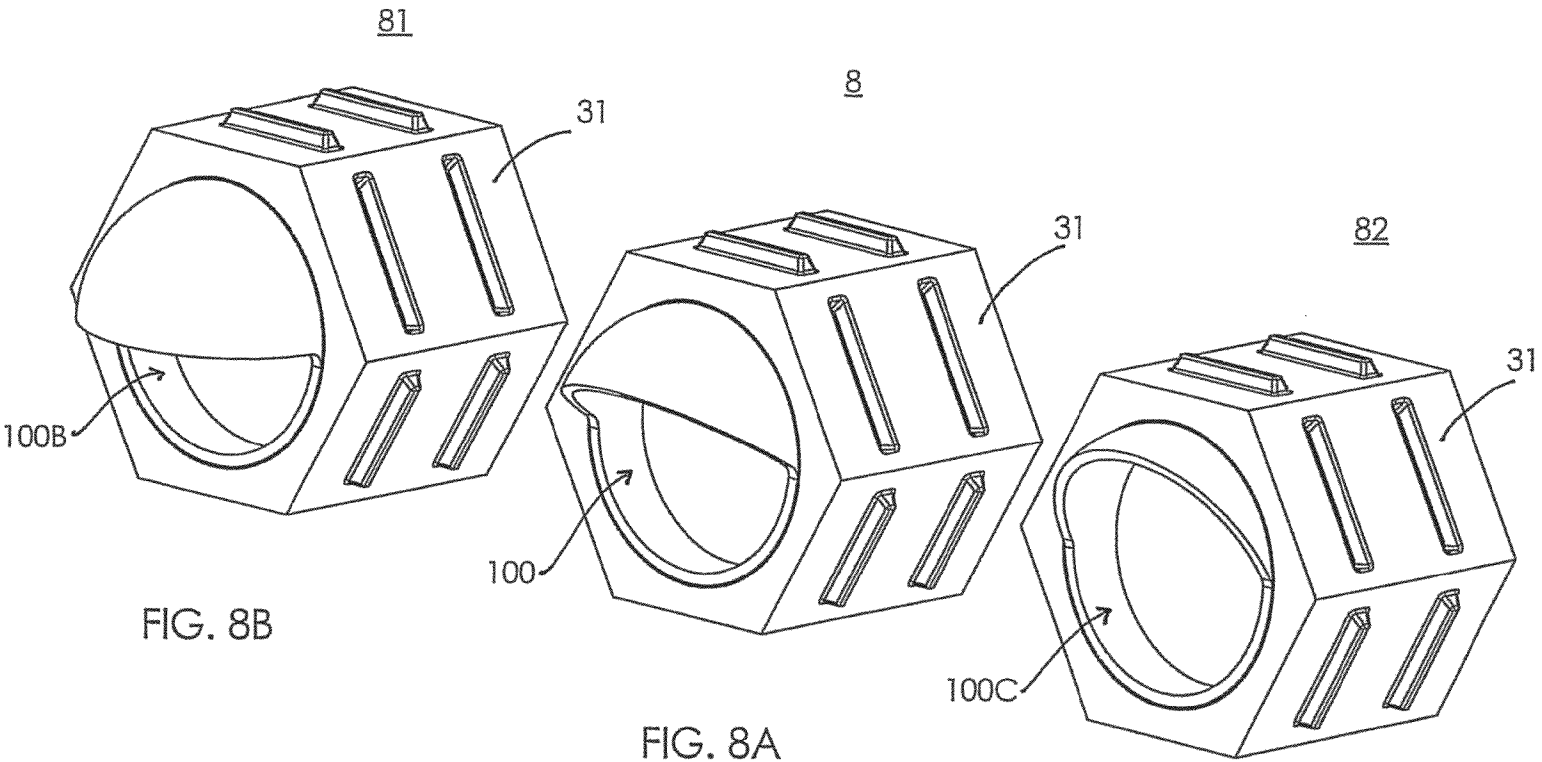
FIGS. 8A-8C are perspective assembled views of refractory assembly units 8, 81 and 82, including the refractory brick member 31 and vector tiles 100, 100B and 100C, respectively, according to other embodiments of the present invention.

For example, vector tile 100 shown in FIG. 4 has a 60° angled dome, which is the same as that shown in FIG. 8A, whereas the vector tile 100B shown in FIG. 8B has a 90° angled dome, and the vector tile 100C shown in FIG. 8C has a 30° angled dome. The vector tiles according to the present invention can be made to have any suitable angle, and it is possible to use other angles within that range as well, such as 45°, for example, as the situation may demand.

A diffusor wall including a plurality of vector tiles, hereinafter referred to as a vector wall, can be constructed using any one type of these vector tiles in conjunction with refractory brick members 31, (i.e., all type 100 vector tiles or all type 100B or 100C vector tiles), or in any combination of these types in concert with one another, as the situation may demand.

The vector tiles can be made of the same refractory material as that of the refractory brick members 3, 31 as described above. In view of the above, vector tiles according to the present invention can likewise be formed from a variety of conventional ceramic forming processes, such as those described above in conjunction with forming the refractory brick members 3, 31. Other suitable methods include, but are not limited to molding, slip casting and pressing, for example.

According to a preferred aspect of the present invention, the annular ring portion 101 and the domed portion 102 of the vector tile 100 are formed as a singular unit in the green state and fired. According to another aspect of the present invention, the annular portion 101 and the domed portion 102 can be formed as separate green components and then integrated during firing to form the vector tile 100, or fired separately and then assembled after firing using refractory cement or otherwise mechanically mated.

Preferably, the vector tile 100 is formed and fired separately with respect to the refractory brick members 31, and is then inserted in the tubular passages of the refractory brick members 31 and affixed therein using any suitable securing means to define a refractory unit assembly. Examples of such suitable securing means include, but are not limited, to mating structures that cooperate with a corresponding mating structure on the brick to physically attach the insert within the brick, such as a tab and slot type configuration. Other suitable means include various adhesives, such as refractory grade cements, for example. Refractory cement is preferred in terms of low cost, availability, reliability, proven performance, and simplifying the overall structure. FIGS. 6 and 8A-8C show examples of refractory unit assemblies 8, 81 and 82, which include refractory brick members 31 and vector tiles 100, 100B and 100C inserted therein and secured in place using refractory cement (not shown).

As shown and described above in connection with FIGS. 5-7, for example, a fired vector tile 100 can be inserted into and securably affixed within the outlet end portion of the tubular passageway 36 of a fired refractory brick member 31 to define a refractory assembly unit 8, which, in turn, can then be used to replace other individual refractory bricks 3 or 31 in an existing diffusor wall, or to assemble a new diffusor wall, as needed. In addition, the vector tiles 100 themselves can be installed in situ, in the passageways 36 of refractory brick members constituting an existing diffusor wall. Moreover, the vector tiles 100 can be removed from the refractory brick members 31 of the diffusor wall in situ, if it is determined that optimal performance is not being achieved, if the vector tile 100 is somehow damaged, or if a different orientation is instead desired in that location.

In another case, a green (i.e., unfired) vector tile 100 can be inserted into the tubular passage of an unfired refractory brick member 31, and the two pieces can be integrated into a unitary refractory structure during the firing process to form a refractory unit. After integration of the refractory structure during firing, the vector tile portion would then at least partially define the passageway shape of the refractory unit, and the domed portion would partially occlude the opening at the outlet end face thereof. These refractory units can also be used as replacements for one or more individual refractory bricks in existing diffusor walls, or in conjunction with a plurality of other refractory bricks, with or without the vector tile or the integral vector tile portion, in the construction of a new diffusor wall. It should be noted, however, that the vector tile portions of this type of integrated refractory unit would not be expected to successfully exhibit the same degree of interchangeability and removability for replacement as would the individual vector tiles described above, which are separately affixed to the refractory bricks.

Alternatively, the vector tiles according to the present invention can also be initially formed as an integrated portion of the refractory brick structure during the initial green formation process. In that case, the vector tile would not constitute a separate member that is later inserted into the brick, before or after firing, but is instead exists as an integral part of the overall structure of the unitary refractory brick. For example, if the unitary refractory brick is formed by a molding process, the mold form or other forming apparatus are designed so as to contemporaneously define the geometrical structure of the portion defining the vector tile as the brick is formed. The forming method is not limited to a molding process, and can include any suitable method that would allow one skilled in the art to integrally form the vector tile along with the brick. In this case, it is not particularly desirable, and perhaps not even possible, to remove or replace only the portion of the otherwise unitary structure that defines the vector tile. In situations demanding modification of that particular portion of the unitary brick structure, the entire refractory brick could be removed and interchanged with a suitable replacement brick member having a vector tile integrally formed therewith.

Figure 9:
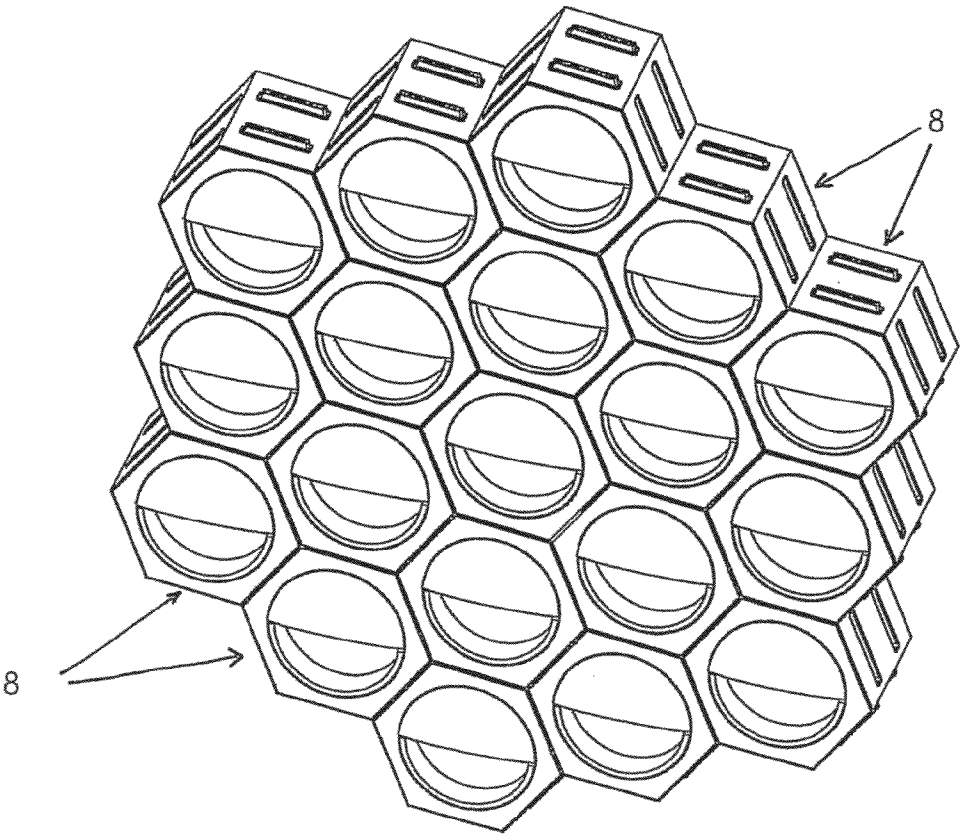
FIG. 9 is a perspective view of a refractory array 62 of refractory assembly units 8, each including a refractory brick member 31 and a vector tile 100 according to the present invention inserted therein, arranged to form a vector wall having a down-pointing domed portion configuration according to one embodiment of the present invention.
Figure 11:
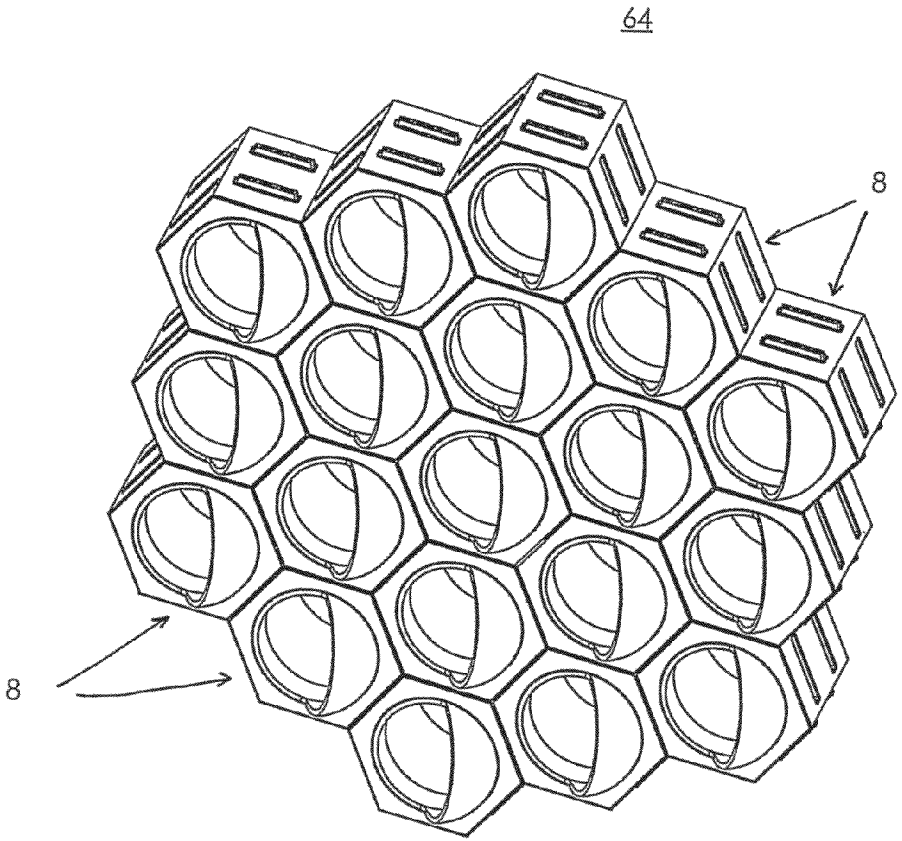
FIG. 11 is a perspective view of a refractory array 64 of refractory assembly units 8 arranged to form a vector wall having a left-pointing domed portion configuration according to another embodiment of the present invention.

FIG. 9 is a perspective view of a refractory array 62 of refractory assembly units 8, each including a refractory brick member 31 and a vector tile 100 according to the present invention inserted therein, arranged to form a vector wall having a down-pointing domed portion configuration according to one embodiment of the present invention. The gas flow is partially blocked from the upper portions of the openings 36*b* of the refractory brick members 31 by the positions of the domed portions 102 of the vector tiles 100, and flows out in a downward direction concentrating the flow in the lower portion of the reaction chamber with an overall downward directionality. FIG. 11 is a perspective view of a refractory array 64 of refractory brick assembly units 8 arranged to form a vector wall having a left-pointing domed portion configuration according to another embodiment of the present invention. The gas flow is blocked from the right-side portions of the openings 36*b* of the refractory brick members 31 by the positions of the domed portions 102 of the vector tiles 100, and flows out from the left side with an overall leftward directionality and turns toward the right.

The redirection of flow achieved by the vector wall configurations according to the present invention are similar to the flow mechanics achieved by the placement of a baffle wall, but the vector walls according to the present invention utilize the entire cross section of the reaction zone as opposed to merely blocking off a potion of the reaction chamber, as in the case of a baffle wall. Additional similar refractory arrays downstream could be configured to direct the flow upward, to the left, to the right or in a vector configuration, effectively creating the desirable snaking flow that is associated with a baffle wall arrangement, but without constraining the flow by simply blocking it and creating dead zones. The vector wall according to the present invention offers more effective use of the reaction chamber volume and allows for increased residence time without requiring any additional reaction chamber volume.

Figure 10:
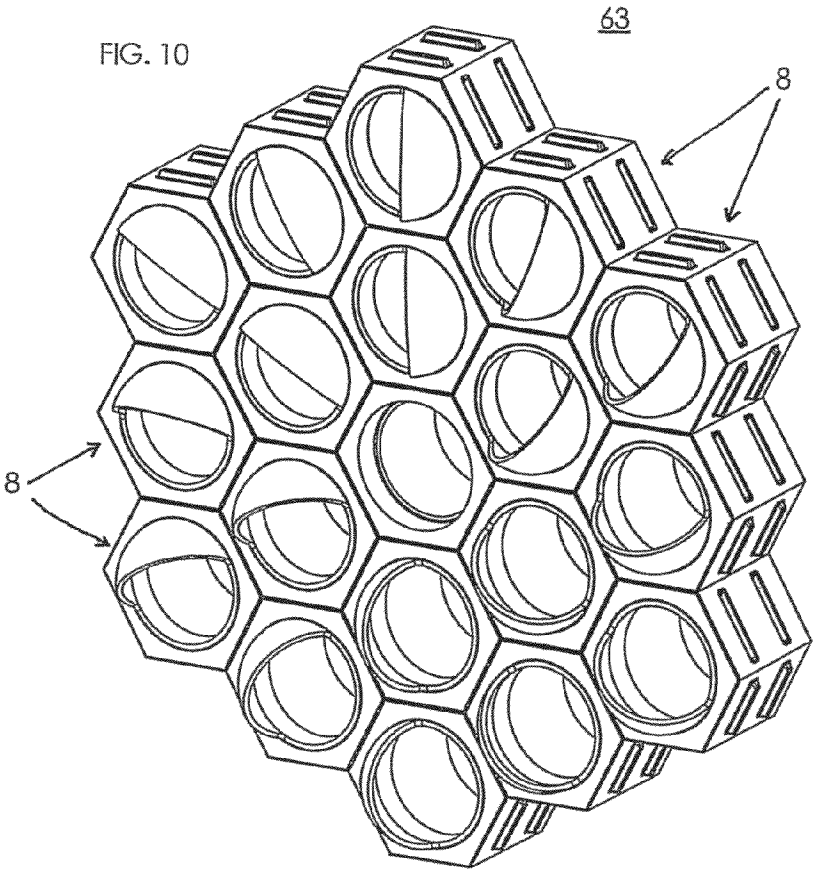
FIG. 10 is a perspective view of a refractory array 63 of refractory assembly units 8 arranged to form a vector wall having a vortex configuration according to another embodiment of the present invention.

FIG. 10 is a perspective view of a refractory array 63 of refractory brick assembly units 8 arranged to form a vector wall having a vortex configuration according to another embodiment of the present invention and used in connection with the Example. As discussed below, the gas flow at the output face of the vector wall (array 63) swirls in a vortex fashion to increase the effective mixing of the gas and improve the overall reaction without increasing the residence time or the length of the reaction chamber.

EXAMPLES

Figure 14:
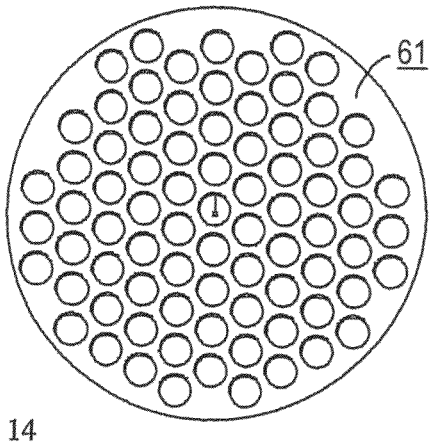
FIG. 14 is a front-end view of a refractory array 61 defining a hexwall according to the Comparative Example including plurality of refractory brick members 3 shown in FIGS. 1A-1C (without any vector tiles provided at the outlet face thereof).

A diffusor wall 61 is composed of a plurality of hexagonal shaped refractory bricks 3 having a substantially cylindrical passageway 36 passing therethrough, arranged to define an array (diffusor wall) that is referred to as a hexwall configuration, as shown in FIG. 14. In this diffusor wall 61, a total of 79 refractory bricks 3 such as those shown in FIGS. 1A-1C are arrayed, wherein the overall thickness of the hexwall is 9", and the inner diameter of the passageway in each refractory brick is 8". This same basic hexwall structure was used for the Example and the Comparative Example, with the exception being that vector tiles are provided in an array 63 as shown according to the vortex configuration of FIG. 8 in the Example, whereas the Comparative Example does not include any vector tiles, as shown in FIG. 14.

The testing conditions for the examples described herein are the same. Specifically, in each of the following examples, Cosmos Flow Works is used to model an air stream under the following operating conditions:

Temperature=2000° F. (1093.3° C.); Pressure=20 psi (1.36 atm); and Gas Velocity=2 ft/s (0.6096 m/s).

Comparative Example

Hexwall Configuration (without Vector Tiles)

Figures 13A, 13B:
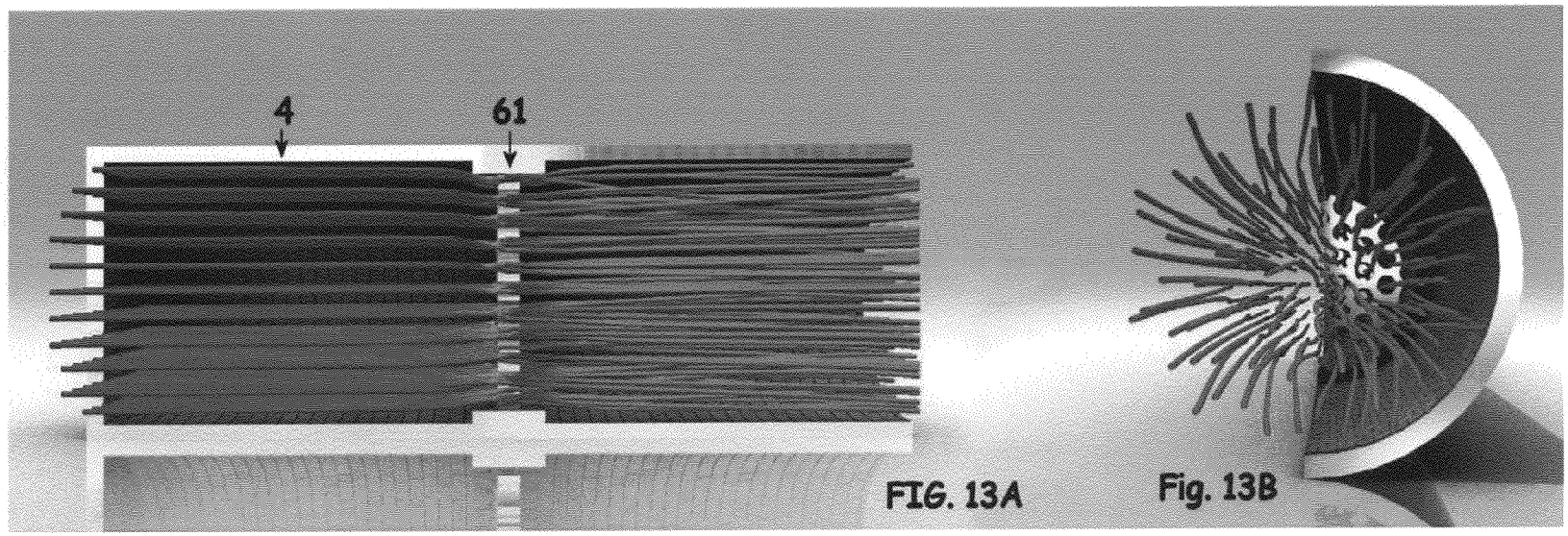
FIG. 13A is a color side-sectional view illustrating the resultant flow properties of a gas in a reaction vessel 4 passing through a refractory array 61 disposed as a hexwall according to the Comparative Example.
FIG. 13B is an outlet face end-view of the section.

FIG. 14 is a front-end view of a refractory array 61 defining a hexwall according to the Comparative Example including plurality of refractory brick members 3 shown in FIGS. 1A-1C (without any vector tiles on the outlet face thereof). FIG. 13A is a color side-sectional view illustrating the resultant flow properties of a gas in a reaction vessel 4 passing through a refractory array 61 disposed as a hexwall according to the Comparative Example, and FIG. 13B is an outlet face end-view of the section.

The results shown in color in FIG. 13 indicate that, with the type of configuration shown in FIG. 14, little mixing is present, and there is a pressure drop of 0.0000592 psi. In continuous processes where the process flow is driven by upstream pressures the unit capacity of a given component within the process is often dictated by pressure drop across that component. Reducing the pressure drop can result in an increase in capacity for that component. In instances where the process is bottlenecked by an individual component capacity, a reduction in pressure drop can lead to an increase in overall process capacity.

Example

Vector Wall Vortex Configuration (with Vector Tiles)

Figures 12A, 12B:
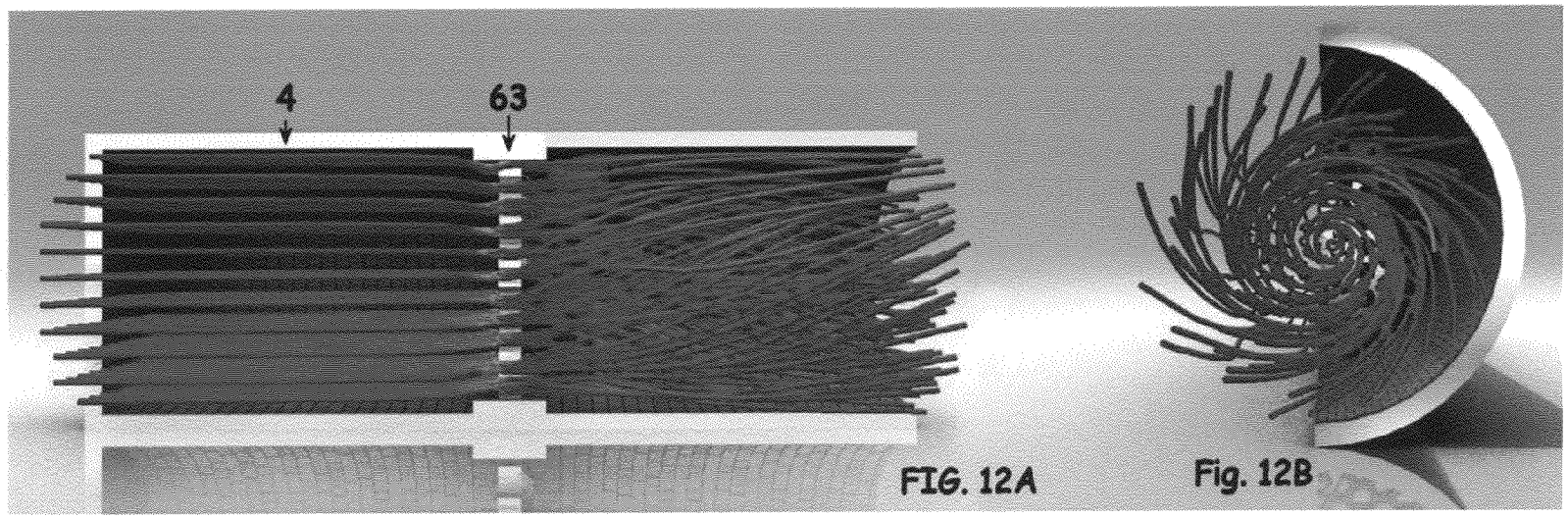
FIG. 12A is a color side-sectional view illustrating the resultant flow properties of a gas in a reaction vessel 4 passing through a refractory array 63 disposed as a vector wall according to the Example and having the vortex configuration shown in FIG. 8, and FIG. 12 B is an outlet face end-view of the section.

FIG. 12A is a color side-sectional view illustrating the resultant flow properties of a gas in a reaction vessel 4 passing through a refractory array 63 disposed as a vector wall according to the Example and having the vortex configuration shown in FIG. 8, and FIG. 12 B is an outlet face end-view of the section.

The results shown in color in FIGS. 12A and 12B indicate that, with the type of vortex vector wall configuration shown in FIG. 8, a significantly increased degree of rotated vortex mixing is present, and there is a pressure drop of only 0.0000657 psi, which is a relatively small increase given the significant increase in mixing. The vortex flow generated by the provision of the vector tiles in this manner allows substantially the entire volume of the reaction chamber to be utilized in the mixing, without incurring a significant pressure drop penalty.

What is claimed is:

1. A refractory array comprising:

a plurality of refractory brick members, each having an inner passageway extending therethrough from a first opening at an inlet end face to an opposed second opening at an outlet end face thereof, said refractory brick members being arranged to define an array having an inlet face and an outlet face; and a plurality of vector tiles, each having an annular portion that is coaxially arranged in a portion of said inner passageway of said refractory brick members and located proximate said second opening at said outlet end face thereof, and each having a domed portion extending from a first surface of said annular portion at a predetermined angle so as to occlude at least a portion of said second openings of said refractory brick members at said outlet face of said array, wherein said vector tiles are arranged so that adjacent ones of said domed portions extend in different directions.

2. A refractory assembly unit comprising;

a refractory brick member having an inner passageway extending therethrough from a first opening at an inlet end face to an opposed second opening at an outlet end face thereof; and a vector tile having an annular portion that is coaxially arranged with respect to a longitudinal extension axis of said inner passageway of said refractory brick member positioned in a portion of said inner passageway of said refractory brick member and located proximate said second opening at said outlet end face thereof, and having a domed portion extending from a first surface of said annular portion at a predetermined angle with respect to the longitudinal extension axis of said inner passageway of said refractory brick member so as to occlude at least a portion of said second opening of said refractory brick member at said outlet end face thereof, wherein said inner passageway of said refractory brick member has an annular rim proximate said second opening having a diameter that is greater than a diameter of a remainder of said inner passageway of said refractory brick member.

3. The refractory assembly unit according to claim 2, wherein said predetermined angle is in a range of 30-90°.

4. The refractory assembly unit according to claim 2, wherein said diameter of said annular rim is greater than said diameter of said remainder of said inner passageway of said refractory brick member by an amount that corresponds to a thickness "t" of said annular portion of said vector tile.

5. The refractory assembly unit according to claim 2, wherein said annular rim extends inwardly from said second opening a distance that corresponds to a height "h" of said annular portion of said vector tile.

6. The refractory assembly unit according to claim 2, further comprising a refractory cement provided in said annular rim and interposed between said refractory brick member and said vector tile.

7. A refractory array comprising a plurality of refractory brick assembly units according to claim 2 arranged to define a wall structure.

8. The refractory array according to claim 7, wherein said vector tiles are arranged so that adjacent ones of said domed portions extend in different directions.

9. A reaction furnace comprising:

a reaction chamber; and at least two refractory arrays according to claim 1 provided in said reaction chamber and spaced a distance apart from one another to define a first, upstream refractory array, and a second, downstream refractory array;

wherein said vector tiles in said first refractory array are arranged to extend in a direction that is different from a direction in which said vector tiles of said second refractory array extend; and wherein said at least two refractory arrays comprises three or more refractory arrays, including at least a third refractory array that is located downstream from said second refractory array.

10. The reaction furnace according to claim 9, wherein said vector tiles in said first refactory array are arranged to extend in of a top-facing, a bottom-facing, a left-facing, a right-facing and a vortex configuration.

11. The reaction furnace according to claim 10, wherein said vector tiles in said second refractory array are arranged to extend in another one of the top-facing, the bottom-facing, the left-facing, the right-facing and the vortex configuration.

12. The reaction furnace according to claim 9, wherein said vector tiles in said first refractory array are arranged to extend in one of a top-facing, a bottom-facing, a left-facing, a right-facing and a vortex configuration, wherein said vector tiles in said second refractory array are arranged to extend in another one of the top-facing, the bottom-facing, the left-facing, the right-facing and the vortex configuration, and wherein said vector tiles in said third vector wall are arranged to extend in one of the top-facing, the bottom-facing, the left-facing, the right-facing and the vortex configuration that is different at least with respect to the configuration of the second vector wall.

* * * * *